US009183789B2

(12) United States Patent
Takahashi et al.

(10) Patent No.: US 9,183,789 B2
(45) Date of Patent: Nov. 10, 2015

(54) DISPLAY DEVICE, AND BRIGHTNESS CONTROL SIGNAL GENERATION METHOD

(75) Inventors: Kohzoh Takahashi, Osaka (JP); Asahi Yamato, Osaka (JP); Taketoshi Nakano, Osaka (JP); Toshihiro Yanagi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 135 days.

(21) Appl. No.: 14/009,153

(22) PCT Filed: Apr. 3, 2012

(86) PCT No.: PCT/JP2012/059039

§ 371 (c)(1),
(2), (4) Date: Oct. 1, 2013

(87) PCT Pub. No.: WO2012/137759

PCT Pub. Date: Oct. 11, 2012

(65) Prior Publication Data

US 2015/0161948 A1 Jun. 11, 2015

(30) Foreign Application Priority Data

Apr. 7, 2011 (JP) ..... 2011-085815

(51) Int. Cl.
*G09G 3/36* (2006.01)
*G09G 3/34* (2006.01)

(52) U.S. Cl.
CPC ..... *G09G 3/3406* (2013.01); *G09G 3/3611* (2013.01); *G09G 2320/062* (2013.01); *G09G 2320/0646* (2013.01);

(Continued)

(58) Field of Classification Search
CPC ..... G09G 5/00; G09G 3/36; G09G 3/34; G06F 3/038
USPC ..... 345/102, 690, 89, 90, 92, 94, 98, 99, 345/100, 208
See application file for complete search history.

(56) References Cited

U.S. PATENT DOCUMENTS 6,816,141 B1 11/2004 Fergason
8,217,968 B2 * 7/2012 Sano et al. ..... 345/690
2009/0122087 A1 5/2009 Maruyama et al.

(Continued)

FOREIGN PATENT DOCUMENTS

JP 2001-265294 A 9/2001
JP 2009-134237 A 6/2009

(Continued)

OTHER PUBLICATIONS

Official Communication issued in International Patent Application No. PCT/JP2012/059039, mailed on May 1, 2012.

*Primary Examiner* — Pegeman Karimi
(74) *Attorney, Agent, or Firm* — Keating & Bennett, LLP

(57) ABSTRACT

Provided is a display device capable of properly controlling a luminance of a backlight on the basis of a plurality of factors. The display device is a display device (10) which includes a BL luminance control signal generating block (44) for generating a BL luminance control signal for controlling a luminance of a backlight unit (30). The BL luminance control signal generating block (44) (i) receives a plurality of BL luminance parameters regarding the luminance of the backlight unit (30), (ii) carries out a calculation process with respect to the plurality of BL luminance parameters and (iii) generates the BL luminance control signal on the basis of a result of the calculation process.

11 Claims, 11 Drawing Sheets

(52) U.S. Cl.
CPC . *G09G 2340/0428* (2013.01); *G09G 2360/144* (2013.01); *G09G 2360/16* (2013.01)

(56) References Cited

U.S. PATENT DOCUMENTS

| | | | | |
|---|---|---|---|---|
| 2009/0207182 | A1 | 8/2009 | Takada et al. | |
| 2010/0007679 | A1* | 1/2010 | Sakaigawa | 345/690 |
| 2010/0149224 | A1* | 6/2010 | Baba et al. | 345/690 |
| 2010/0225674 | A1* | 9/2010 | Choe et al. | 345/690 |
| 2011/0012824 | A1* | 1/2011 | Nonaka et al. | 345/102 |
| 2012/0249613 | A1 | 10/2012 | Takada et al. | |

FOREIGN PATENT DOCUMENTS

| | | | |
|---|---|---|---|
| JP | 2009-192887 | A | 8/2009 |
| JP | 2009-210924 | A | 9/2009 |
| JP | 2009-271169 | A | 11/2009 |

* cited by examiner

CALCULATION EXAMPLE 1: WHERE PARAMETER IS DUTY RATIO

PARAMETER A (DUTY RATIO) = 70/100

PARAMETER B (DUTY RATIO) = 30/100

DUTY RATIO OF PWM SIGNAL TO BE OUTPUTTED = 70×30/100×100 = 21/100

DUTY RATIO OF PWM SIGNAL TO BE OUTPUTTED: 21%

CALCULATION EXAMPLE 2: WHERE PARAMETER IS LUMINANCE LEVEL

PARAMETER A (LUMINANCE LEVEL) = 12/16

PARAMETER B (LUMINANCE LEVEL) = 4/8

LUMINANCE LEVEL FOR GENERATION OF PWM SIGNAL = 12×4/16×8 = 6/16

OUTPUT OF PWM SIGNAL CORRESPONDING TO LUMINANCE LEVEL (55%)

FIG. 5

TABLE IN WHICH LUMINANCE LEVEL IS CORRELATED WITH DUTY RATIO

| LUMINANCE LEVEL | DUTY RATIO |
|---|---|
| 1 | 10 |
| 2 | 20 |
| 3 | 25 |
| – | – |
| 6 | 55 |
| – | – |
| 16 | 100 |

CALCULATION EXAMPLE 3: WHERE PARAMETER IS DUTY RATIO

PARAMETER A (DUTY RATIO) = 80/100

PARAMETER B (DUTY RATIO) = 60/100

PARAMETER C (DUTY RATIO) = 50/100

DUTY RATIO OF PWM SIGNAL TO BE OUTPUTTED = $80 \times 60 \times 50/100 \times 100 \times 100$
= 24/100

DUTY RATIO OF PWM SIGNAL TO BE OUTPUTTED: 24%

DISPLAY DEVICE, AND BRIGHTNESS CONTROL SIGNAL GENERATION METHOD

TECHNICAL FIELD

The present invention relates to a display device, particularly, control of a luminance of a backlight.

BACKGROUND ART

In order to, for example, improve display quality and reduce power consumption, a luminance of a backlight has been controlled in a display device.

Specifically, there have proposed techniques such as (i) a first technique of controlling the luminance in accordance with brightness of an environment and (ii) a second technique of controlling the luminance in accordance with an image to be displayed.

Examples of the first technique include LABC (Light Adaptive Backlight Control). Examples of the second technique include CABC (Content Adaptive Backlight Control).

LABC controls a luminance of a backlight in accordance with an illuminance on the periphery of a display device (see Patent Literature 1 below). According to a technique such as a technique described in Patent Literature 1, the backlight is controlled to be turned on or off, in accordance with an illuminance level detected by an illuminance sensor.

CABC controls a luminance of a backlight in accordance with, for example, an image to be displayed (see Patent Literature 2 below).

CITATION LIST

Patent Literatures

Patent Literature 1
Japanese Patent Application Publication, Tokuikai, No. 2001-265294 A
Patent Literature 2
U.S. Pat. No. 6,816,141, specification

SUMMARY OF INVENTION

Technical Problem

The above-described backlight luminance controls will cause a problem in a case where there exist a plurality of luminance control factors, that is, a plurality of matters which should be taken into consideration so that an optimal luminance is determined.

(Schematic Configuration)

The following description will discuss luminance control with reference to FIG. 10. FIG. 10 is a block diagram schematically illustrating the luminance control according to a conventional technique.

As illustrated in FIG. 10, a display device 10 includes (i) a BL (backlight; hereinafter same as above) control block A 110, (ii) a BL control block B 120, (iii) a control signal synthesizing section 130, (iv) a BL unit controlling section 140 and (v) a backlight unit 150.

The BL control block A 110 and the BL control block B 120 are connected to the control signal synthesizing section 130.

The BL control block A 110 supplies a PWM (Pulse Width Modulation) signal A to the control signal synthesizing section 130. The BL control block B 120 supplies a PWM signal B to the control signal synthesizing section 130.

The control signal synthesizing section 130 superimposes the PWM signal A and the PWM signal B on each other so as to synthesize a PWM signal A×B.

The control signal synthesizing section 130 then supplies the PWM signal A×B to the BL unit controlling section 140 that is connected to the control signal synthesizing section 130.

The BL unit controlling section 140 controls, in accordance with the PWM signal A×B, a luminance of the backlight unit 150 that is connected to the BL unit controlling section 140.

(Synthesis of Signal)

The following description will discuss, with reference to FIG. 11, how the control signal synthesizing section 130 synthesizes the PWM signal A×B from the PWM signal A and the PWM signal B. FIG. 11 is a waveform diagram schematically illustrating superimposition of PWM signals according a conventional technique.

As illustrated in FIG. 11, in a case where two different PWM signals (a PWM signal A and a PWM signal B) are superimposed on each other, a defect, such as turn-off of the backlight unit 150, will be caused due to loss of duty.

Specifically, for example, in a case where first and second PWM signals, each having a duty ratio of 50%, are superimposed on each other, a high (High) part of the first PWM signal and a low (Low) part of the second PWM signal will be superimposed on each other depending on frequencies or phases of the first and second PWM signals. This possibly causes loss of duty. Such loss of duty causes the backlight unit 150 to be turned off.

FIG. 11 illustrates (i) the PWM signal A, (ii) the PWM signal B whose phase is shifted by a half cycle from that of the PWM signal A and (iii) a PWM signal A×B (duty: 0%) in which the PWM signal A and the PWM signal B are superimposed on each other.

The present invention was made in order to solve the problem, and an object of the present invention is to provide a display device capable of properly controlling a luminance of a backlight on the basis of a plurality of factors.

Solution to Problem

In order to attain the object, a display device of the present invention is configured to be a display device which includes a signal generating section for generating a luminance control signal for controlling a luminance of a backlight, the signal generating section (i) receiving a plurality of parameters regarding the luminance of the backlight, (ii) carrying out a calculation process with respect to the plurality of parameters, and (iii) generating the luminance control signal on the basis of a result of the calculation process.

In order to attain the object, a method, of the present invention, of generating a luminance control signal is arranged to be a method of generating a luminance control signal for controlling a luminance of a backlight, the method including the steps of: (i) carrying out a calculation process in advance with respect to a plurality of parameters regarding the luminance; and (ii) generating the luminance control signal on the basis of a result of the calculation process.

According the configuration or the arrangement, a plurality of luminance control signals, such as a plurality of PWM signals, are not superimposed on each other, but (i) a plurality of parameters regarding the luminance of the backlight are subjected to a calculation process, and then (ii) a luminance control signal is generated on the basis of a result of the calculation process.

It is therefore unlikely to cause a defect, such as turn-off of the backlight due to change of a luminance control signal to an undesired signal, e.g., loss of duty of a PWM signal.

It is therefore possible to properly control the luminance of the backlight on the basis of a plurality of factors.

Advantageous Effects of Invention

A display device of the present invention is configured so that a signal generating section (i) receives a plurality of parameters regarding a luminance of a backlight, (ii) carries out a calculation process with respect to the plurality of parameters and (iii) generates a luminance control signal on the basis of a result of the calculation process.

A method, of the present invention, of generating a luminance control signal includes the steps of: (i) carrying out a calculation process in advance with respect to a plurality of parameters regarding the luminance; and (ii) generating the luminance control signal on the basis of a result of the calculation process.

It is therefore possible to bring about an effect of properly controlling the luminance of the backlight on the basis of a plurality of factors.

BRIEF DESCRIPTION OF DRAWINGS

FIG. 5 illustrates a correlation table, in accordance with an embodiment of the present invention, which shows how a luminance level and a duty ratio are correlated with each other.

DESCRIPTION OF EMBODIMENTS

The following description will discuss an embodiment of the present invention.

Embodiment 1

Embodiment 1 of the present invention will be described below with reference to FIGS. 1 through 7.

(Schematic Configuration)

Figure 1:
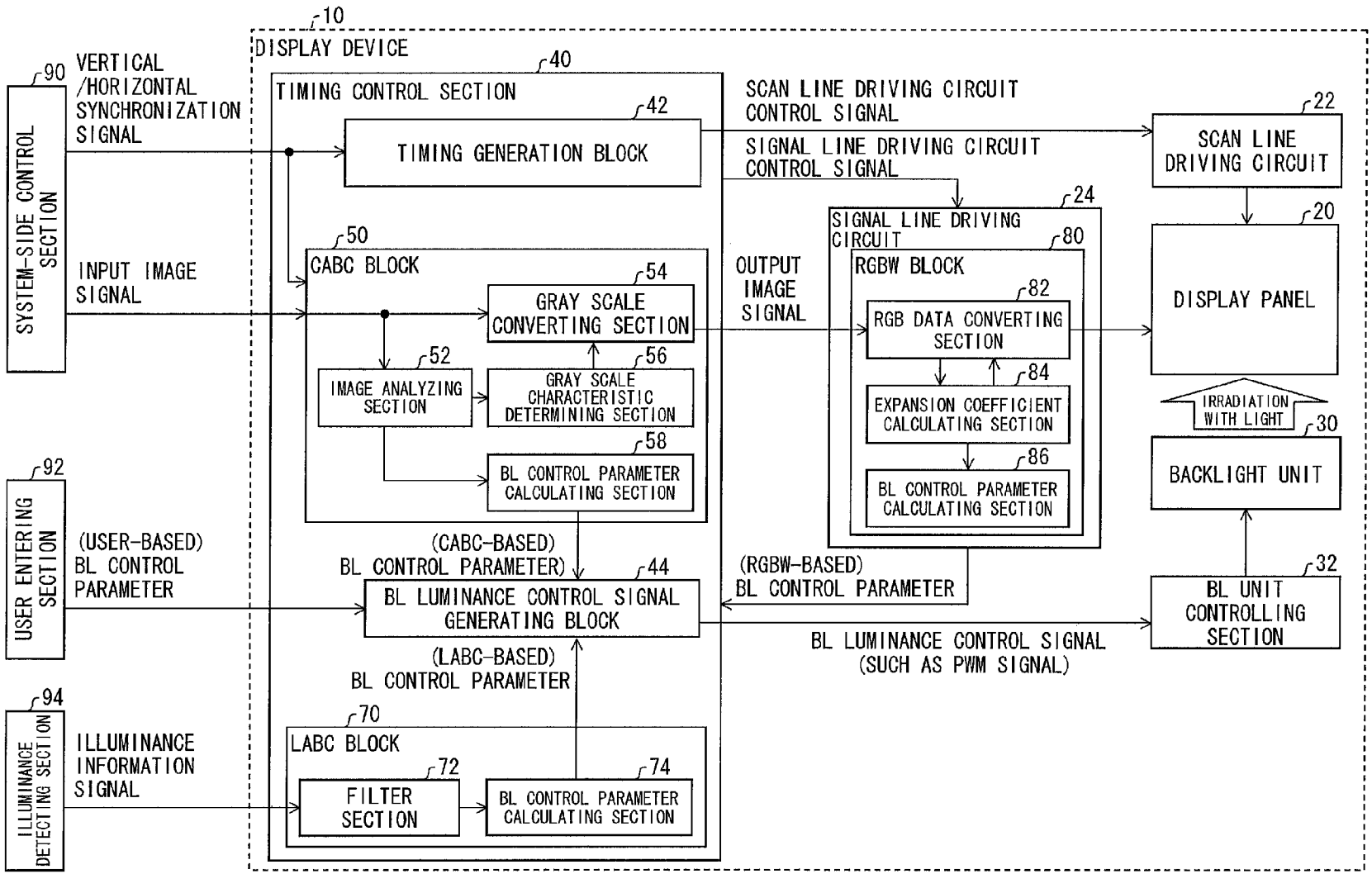
FIG. 1 is a block diagram schematically illustrating a configuration of a display device in accordance with an embodiment of the present invention.

A configuration of a display device 10 of Embodiment 1 will be schematically described below with reference to FIG. 1. FIG. 1 is a block diagram schematically illustrating the configuration of the display device 10.

The display device 10 mainly includes (i) a timing control section 40, (ii) a scan line driving circuit 22, (iii) a signal line driving circuit 24, (iv) a display panel 20, (v) a backlight unit 30 and (vi) a BL (backlight) unit controlling section 32 (see FIG. 1).

Each of the scan line driving circuit 22 and the signal line driving circuit 24 supplies, to the display panel 20, signals for image display.

The backlight unit (backlight) 30 backlights the display panel 20. The BL unit controlling section 32 controls a luminance and the like of the backlight unit 30.

(Timing Control Section)

The timing control section 40 will be described below.

The timing control section 40 of Embodiment 1 mainly includes (i) a timing generation block 42, (ii) a CABC (Content Adaptive Backlight Control) block 50, (iii) a BL luminance control signal generating block 44 serving as a signal generating section and (iv) an LABC (Light Adaptive Backlight Control) block 70.

(Timing Generation Block)

The timing generation block 42 generates a scan line driving circuit control signal and a signal line driving circuit control signal in response to supplied vertical/horizontal synchronization signals.

Specifically, the timing generation block 42 is connected to a system-side control section 90 so as to receive the vertical/horizontal synchronization signals from the system-side control section 90.

The timing generation block 42 (i) generates a scan line driving circuit control signal and a signal line driving circuit control signal in response to the vertical/horizontal synchronization signals and (ii) supplies the scan line driving circuit control signal and the signal line driving circuit control signal to the scan line driving circuit 22 and the signal line driving circuit 24, respectively, which are connected to the timing generation block 42.

(CABC Block)

The CABC (Content Adaptive Backlight Control) block 50 (i) carries out a gray scale conversion with respect to an input image signal in accordance with a luminance of an inputted image etc. and (ii) supplies, as an output image signal, the input image signal to the signal line driving circuit 24. The CABC block 50 also calculates, on the basis of the input image signal, a parameter which is used to control the luminance of the backlight unit 30.

The CABC block 50 includes (i) an image analyzing section 52, (ii) a gray scale converting section 54, (iii) a gray scale characteristic determining section 56, and (iv) a BL control parameter calculating section 58.

The CABC block 50 receives, from the system-side control section 90, vertical/horizontal synchronization signals and an input image signal. Specifically, the input image signal is supplied to the gray scale converting section 54 and the image analyzing section 52.

Note here that, in a case where an image is displayed without an input image signal being subjected to any special process, the input image signal is (i) supplied to the gray scale converting section 54, (ii), if necessary, subjected to gray scale conversion, and then (iii) supplied, as an output image signal, to the signal line driving circuit 24.

On the other hand, in a case where an output image signal is generated after an input image signal is subjected to an image process such as shift of a gray scale value, (i) the input image signal is supplied to the image analyzing section 52, (ii) the gray scale characteristic determining section 56 determines, on the basis of an image analysis result obtained by the image analyzing section 52, what image process should be carried out on the input image signal (iii) the gray scale converting section 54 generates the output image signal based on a determination made by the gray scale characteristic determining section 56, and then (iv) the gray scale converting section 54 supplies the output image signal to the signal line driving circuit 24.

Note that the CABC block 50 determines a suitable luminance of the backlight unit 30 on the basis of the image analysis result. Specifically, the image analyzing section 52 supplies the image analysis result to the BL control parameter calculating section 58. Based on the image analysis result, the BL control parameter calculating section 58 (i) calculates a BL control parameter which is used to control the luminance of the backlight unit 30 and then (ii) supplies the BL control parameter to the BL luminance control signal generating block 44.

The following description will discuss examples of how (i) the CABC block 50 makes an image analysis and (ii) the luminance of the backlight unit 30 is controlled.

According to an example, in a case of a bright image, the luminance of the backlight unit 30 is increased so that the bright image is displayed more vividly, whereas, in a case of an image which verges on black, the luminance of the backlight unit 30 is decreased so that a black color looks like more black. This causes an increase in contrast.

According to another example, in a case of a darkish input image, (i) a gray scale value of the darkish input image is shifted to become higher and (ii) the luminance of the backlight unit 30 is shifted to become lower.

This allows an image having a desired brightness to be displayed, and also allows power consumption to be reduced.

(LABC Block)

The LABC (Light Adaptive Backlight Control) block 70 will be described below. The LABC block 70 determines a suitable luminance of the backlight unit 30 in accordance with an environmental illuminance of the display device 10, for example, a brightness on the periphery of the display device 10.

The LABC block 70 includes a filter section 72 and a BL control parameter calculating section 74. The filter section 72 is connected to an illuminance detecting section 94.

The illuminance detecting section 94 (i) measures the brightness on the periphery of the display device 10 and (ii) supplies, as an illuminance information signal, the brightness thus measured to the filter section 72.

The filter section 72 converts the illuminance information signal into a more stable illuminance information signal by eliminating noise components from the illuminance information signal.

The BL control parameter calculating section 74 (i) determines a suitable luminance of the backlight unit 30 on the basis of the illuminance information signal which has been supplied from the filter section 72 and (ii) calculates a BL control parameter and then supplies the BL control parameter to the BL luminance control signal generating block 44.

Note that a location where the illuminance detecting section 94 is provided is not limited to a specific location. For example, the illuminance detecting section 94 can be provided in the display device 10 or can be provided independently of the display device 10.

The following description will discuss examples of how the luminance of the backlight unit 30 is controlled in the LABC block 70.

According to an example, in a case where the environmental illuminance of the display device 10 is high, the luminance of the backlight unit 30 is increased so that a display quality is prevented from being deteriorated because of the fact that environmental light on the display panel 20 gets into a viewer's eye.

According to another example, in a case where the environmental illuminance of the display device 10 is low, the luminance of the backlight unit 30 is decreased so that too dazzling display is prevented.

(RGBW Block)

An RGBW block 80 will be described below. The RGBW block 80 (i) converts an RGB (Red, Green, and Blue) output image signal into an RGBW (Red, Green, Blue, and White) image signal and (ii) calculates a suitable luminance of the backlight unit 30 on the basis of luminances of pixels corresponding to W.

A location where the RGBW block 80 is provided is not limited to a specific location. According to Embodiment 1, the RGBW block 80 is provided in the signal line driving circuit 24.

The RGBW block 80 includes an RGB data converting section 82, an expansion coefficient calculating section 84, and a BL control parameter calculating section 86.

The RGB data converting section 82 (i) receives an RGB output image signal from the gray scale converting section 54 (as early described) and (ii) converts the RGB output image signal into an RGBW image signal. During the converting, the expansion coefficient calculating section 84, which is connected to the RGB data converting section 82, calculates a luminance of a pixel corresponding to W.

The RGBW block 80 then supplies the RGBW image signal to the display panel 20.

The expansion coefficient calculating section 84 supplies, to the BL control parameter calculating section 86, information on the luminance of the pixel corresponding to W. The BL control parameter calculating section 86 (i) calculates a BL control parameter on the basis of the information and (ii) supplies the BL control parameter to the BL luminance control signal generating block 44.

The following description will discuss an example of how the luminance of the backlight unit 30 is controlled in the RGBW block 80. According to an example, in a case where the luminance of the pixel corresponding to W is high, the luminance of the backlight unit 30 is decreased so that power consumption is reduced.

Note that a pixel color to be added by converting an RGB image signal into a four-color image signal is not limited to W, and can therefore be any of various colors, such as yellow and another green, instead of white.

In a case where a pixel color other than W is added, as with a case where the pixel color to be added is W, the BL control parameter calculating section 86 calculates a BL control parameter from the perspective that, for example, an appropriately bright display is obtained.

(User Entering Section)

Next, a user entering section 92 will be described below. A user of the display device 10 enters, via the user entering section 92, a desired luminance of a displayed image and a desired luminance of the backlight unit 30.

The user entering section 92 (i) calculates a BL control parameter in accordance with the entering by the user and (ii) supplies the BL control parameter to the BL luminance control signal generating block 44.

Note that a location where the user entering section 92 is provided is not limited to a specific location. The user entering section 92 can be provided, for example, in the display device 10 or independently of the display device 10.

(BL Luminance Control Signal Generating Block) The BL luminance control signal generating block 44 will be described below. The BL luminance control signal generating block 44 (i) generates a BL luminance control signal (luminance control signal) and (ii) supplies the BL luminance control signal to the BL unit controlling section 32.

According to Embodiment 1, the BL luminance control signal generating block 44 is provided in the timing control section 40. Note, however, that a location where the BL luminance control signal generating block 44 is provided is not limited to a specific location. For example, the BL luminance control signal generating block 44 can be provided in the display device 10, independently of the timing control section 40.

The BL luminance control signal generating block 44 receives a plurality of BL control parameters, as has been described. That is, the BL luminance control signal generating block 44 receives (i) a CABC-based BL control parameter from the BL control parameter calculating section 58 of the CABC block 50, (ii) a LABC-based BL control parameter from the BL control parameter calculating section 74 of the LABC block 70, (iii) an RGBW-based BL control parameter from the BL control parameter calculating section 86 of the RGBW block 80 and (iv) a user-based BL control parameter from the user entering section 92.

Note that the kind and the number of BL control parameters to be supplied to the BL luminance control signal generating block 44 are not particularly limited, provided that the BL luminance control signal generating block 44 receives two or more BL control parameters.

(Generation of BL Luminance Control Signal)

The following description will discuss how the BL luminance control signals are generated.

According to the BL luminance control signal generating block 44 of Embodiment 1, (i) a plurality of inputted BL control parameters are subjected to a calculation process in advance so that a parameter is obtained and (ii) a BL luminance control signal is generated on the basis of the parameter.

Conventionally, in a case where a plurality of factors were needed to determine a luminance of a backlight unit, a signal for actually controlling the luminance of the backlight unit was generated by combining a plurality of BL luminance control signals, for example, by combining PWM (Pulse Width Modulation) signals (as early described).

On the other hand, according to the BL luminance control signal generating block 44 of Embodiment 1, no process is carried out with respect to a plurality of control signals, but (i) a plurality of control parameters are processed so as to calculate a parameter and then (ii) a control signal is generated on the basis of the parameter. This will be described below with reference to drawings.

Figure 2:
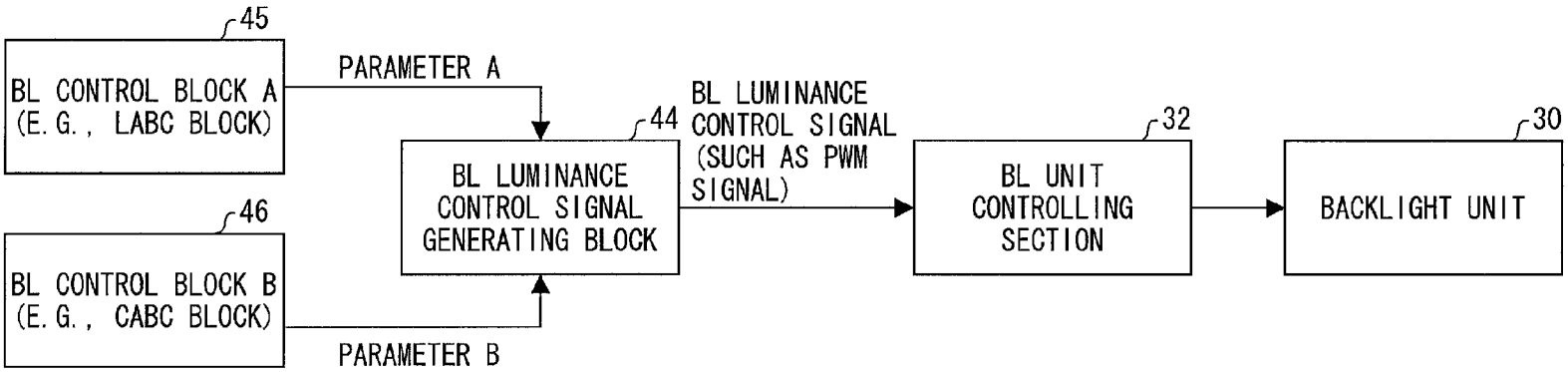
FIG. 2 is a block diagram schematically illustrating luminance control in accordance with an embodiment of the present invention.

FIG. 2 is a block diagram schematically illustrating how luminance is controlled in the display device 10 of Embodiment 1.

FIG. 2 illustrates, for ease of description, a case where only two different parameters (parameters regarding the luminance of the backlight) are supplied to the BL luminance control signal generating block 44.

As illustrated in FIG. 2, the BL luminance control signal generating block 44 is connected to a BL control block A 45 and a BL control block B 46. The BL control block A 45 and the BL control block B 46 correspond to, for example, the LABC block 70 and the CABC block 50, respectively.

The BL control block A 45 and the BL control block B 46 supply, to the BL luminance control signal generating block 44, not BL luminance control signals but respective parameters (a parameter A and a parameter B) regarding control of the luminance of the backlight unit 30.

In the BL luminance control signal generating block 44, (i) the parameters A and B are subjected to a calculation process and then (ii) a BL luminance control signal is generated on the basis of a result of the calculation process.

(Calculation Example 1 of Parameter)

Figure 3:
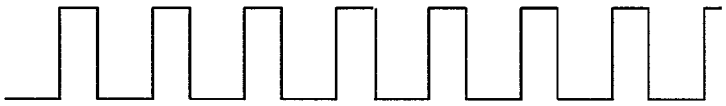
FIG. 3 is a view illustrating an example of how to calculate parameters in accordance with an embodiment of the present invention.

Examples of how to calculate parameters will be described below with reference to FIG. 3. FIG. 3 is a view illustrating an example of how to calculate parameters in Embodiment 1.

Calculation Example 1 illustrates an example case where (i) a parameter (BL control parameter) to be supplied to the BL luminance control signal generating block 44 is a duty ratio and (ii) a BL luminance control signal to be outputted from the BL luminance control signal generating block 44 is a PWM signal (see FIG. 3).

Furthermore, in Calculation Example 1, a calculation process is a multiplication.

In Calculation Example 1, the parameter A is a duty ratio of 70/100, and the parameter B is a duty ratio of 30/100 (see FIG. 3).

The two different duty ratios are multiplied by each other, so that a duty ratio of 21/100 is obtained. On the basis of the duty ratio of 21/100, a PWM signal is generated as a BL luminance control signal. Specifically, the BL luminance control signal generating block 44 (i) generates a PWM signal having a duty of 21% and (ii) supplies the PWM signal to the BL unit controlling section 32.

This allows the luminance of the backlight unit 30 to be properly controlled, without causing, for example, (i) an unintentional elimination of a signal and (ii) an unintentional turn-off of the backlight unit 30, each of which will occur in a case where two different PWM signals are superimposed on each other.

(Calculation Example 2 of Parameter)

Figure 4:
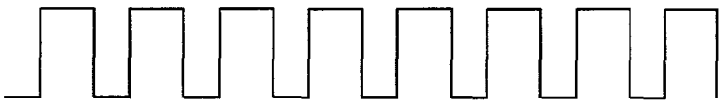
FIG. 4 is a view illustrating another example of how to calculate parameters in accordance with an embodiment of the present invention.

Another example of how to calculate parameters will be described below with reference to FIG. 4. FIG. 4 is a view illustrating the another example of how to calculate parameters in Embodiment 1.

Calculation Example 2 (see FIG. 4) is different from Calculation Example 1 (see FIG. 3) in that a parameter (BL control parameter) to be supplied to the BL luminance control signal generating block 44 is a luminance level in Calculation Example 2, whereas the parameter is a duty ratio in Calculation Example 1.

Specifically, according to Calculation Example 2, the parameter A is a luminance level of 12/16, and the parameter B is a luminance level of 4/8 (see FIG. 4).

The two different luminance levels are multiplied by each other, so that a luminance level of 6/16 is obtained. On the basis of the luminance level of 6/16, a PWM signal is generated as a BL luminance control signal.

Note that, in a case of Calculation Example 2, a correlation table, which shows how a luminance level and a duty ratio of a PWM signal are correlated with each other, is prepared in advance. FIG. 5 illustrates an example of the correlation table.

In Calculation Example 2, the luminance level of 6/16 is obtained, and then a duty ratio of 55 is obtained with reference to the correlation table (see FIG. 5). The BL luminance control signal generating block 44 (i) generates, as a BL luminance control signal, a PWM signal having a duty ratio of 55% and (ii) supplies the PWM signal to the BL unit controlling section 32.

This prevents an occurrence of a problem which will be caused in a case where two PWM signals are superimposed on each other, as with a case of Calculation Example 1. It is therefore possible to properly control the luminance of the backlight unit 30.

Note that Embodiment 1 has described (i) an example case where a BL control parameter is a duty ratio and (ii) an example case where the BL control parameter is a luminance level. Note, however, that kinds of the BL control parameter are not limited to the duty ratio and the luminance level.

Note also that Embodiment 1 has described an example case where a BL luminance control signal is a PWM signal. Note, however, that kinds of the BL luminance control signal are not limited to the PWM signal. The BL luminance control signal can be, for example, an analog voltage signal or digital data.

In a case where the BL luminance control signal is the digital data, the BL unit controlling section 32 (i) receives the digital data via an I/F such as an SPI or an I2C and (ii) controls the luminance of the backlight unit 30 in accordance with the digital data.

Note also that Embodiment 1 has described an example case where the BL luminance control signal generating block 44 carried out a multiplication as a calculation process. Note, however, that the calculation process to be made is not limited to the multiplication. The calculation process can be, for example, addition, averaging, or utilization of a combination table.

Note here that what is meant by "utilization of a combination table" is that a BL luminance control signal is generated on the basis of a table, prepared in advance, in which PWM duty ratios are correlated with respective combinations of parameters, for example, a PWM duty ratio is set to 25% in a case where a parameter A equals to 0 (zero) and a parameter B equals to 1.

Note also that the calculation process is not limited to a single calculation. Two or more different calculations can be made in combination.

Examples of the two or more different calculations include (i) a calculation of an arithmetic mean value, (ii) a calculation of a weighted average efficiency (an average value of weighted parameters), (iii) extraction of a maximum value, (iv) extraction of a minimum value, and (v) calculation of a median.

Some of (i) the calculation process examples and (ii) a process based on the table can be combined. For example, in a case where there are three different parameters (parameters A, B and C), the following calculation process can be made. That is, an average value (arithmetic mean value) of the parameter A and the parameter B is calculated, and then the average value is multiplied by the parameter C.

(Calculation Example 3 of Parameter)

Figure 6:
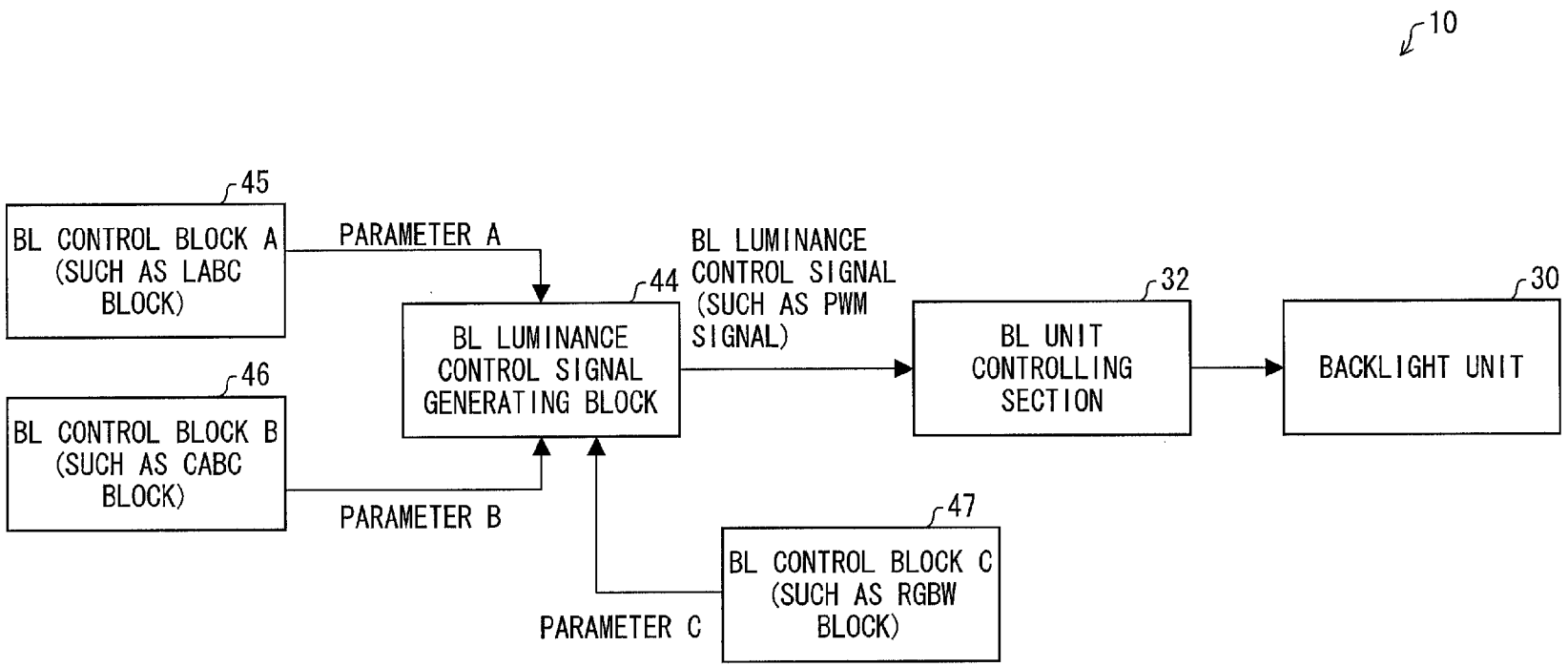
FIG. 6 is a block diagram schematically illustrating another luminance control in accordance with an embodiment of the present invention.
Figure 7:
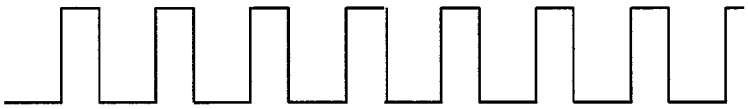
FIG. 7 is a view illustrating yet another example of how to calculate parameters in accordance with an embodiment of the present invention.

A further example of how to calculate parameters will be described below with reference to FIGS. 6 and 7. FIG. 6 is a block diagram schematically illustrating another luminance control of Embodiment 1. FIG. 7 is a view illustrating a further example of how to calculate parameters.

Calculation Example 3 is different from Calculation Example 1 in the number of parameters. Specifically, according to Calculation Example 3, a BL luminance control signal generating block 44 is connected to three different BL control blocks (i.e., a BL control block A 45, a BL control block B 46, and a BL control block C 47) (see FIG. 6), whereas, according to Calculation Example 1, the BL luminance control signal generating block 44 is connected to the two BL control blocks (i.e., the BL control block A 45 and the BL control block B 46) (see FIG. 2). In other words, according to a display device 10 illustrated in FIG. 6, the BL luminance control signal generating block 44 is connected to the BL control block C 47, in addition to the BL control block A 45 and the BL control block B 46. The BL control block C 47 corresponds to, for example, the RGBW block 80.

As illustrated in FIG. 6, the BL luminance control signal generating block 44 receives a parameter C from the BL control block C 47, in addition to a parameter A from the BL control block A 45 and a parameter B from the BL control block B 46.

In the BL luminance control signal generating block 44, (i) the parameters A, B and C are subjected to a calculation process and (ii) a BL luminance control signal is generated on the basis of a result of the calculation process.

Calculation Example 3 will be described below with reference to FIG. 7.

As early described, Calculation Example 3 is different from Calculation Example 1 in the number of parameters to be taken into consideration.

In Calculation Example 3, the parameter A is a duty ratio of 80/100, the parameter B is a duty ratio of 60/100, and the parameter C is a duty ratio of 50/100 (see FIG. 7).

The three different duty ratios are multiplied by one another, so that a duty ratio of 24/100 is obtained. On the basis of the duty ratio of 24/100, a PWM signal is generated as a BL luminance control signal. Specifically, the BL luminance control signal generating block 44 (i) generates a PWM signal having a duty ratio of 24% and (ii) supplies the PWM signal to a BL unit controlling section 32.

This makes it possible to properly control the luminance of the backlight unit 30.

Even in a case where the number of parameters is increased, it is thus possible to make a calculation process in the same manner as that made in a case where the number of parameters is two. That is, even in a case where the BL luminance control signal generating block 44 receives, for example, four different BL control parameters (see FIG. 1), it is possible to make a calculation process with respect to the four different BL control parameters in the same manner as that made in Calculation Example 3.

Note that, even in a case where the kind of parameters is a parameter, such as a luminance level, other than a duty ratio, it is possible to similarly make a calculation process.

Embodiment 2

Figure 8:
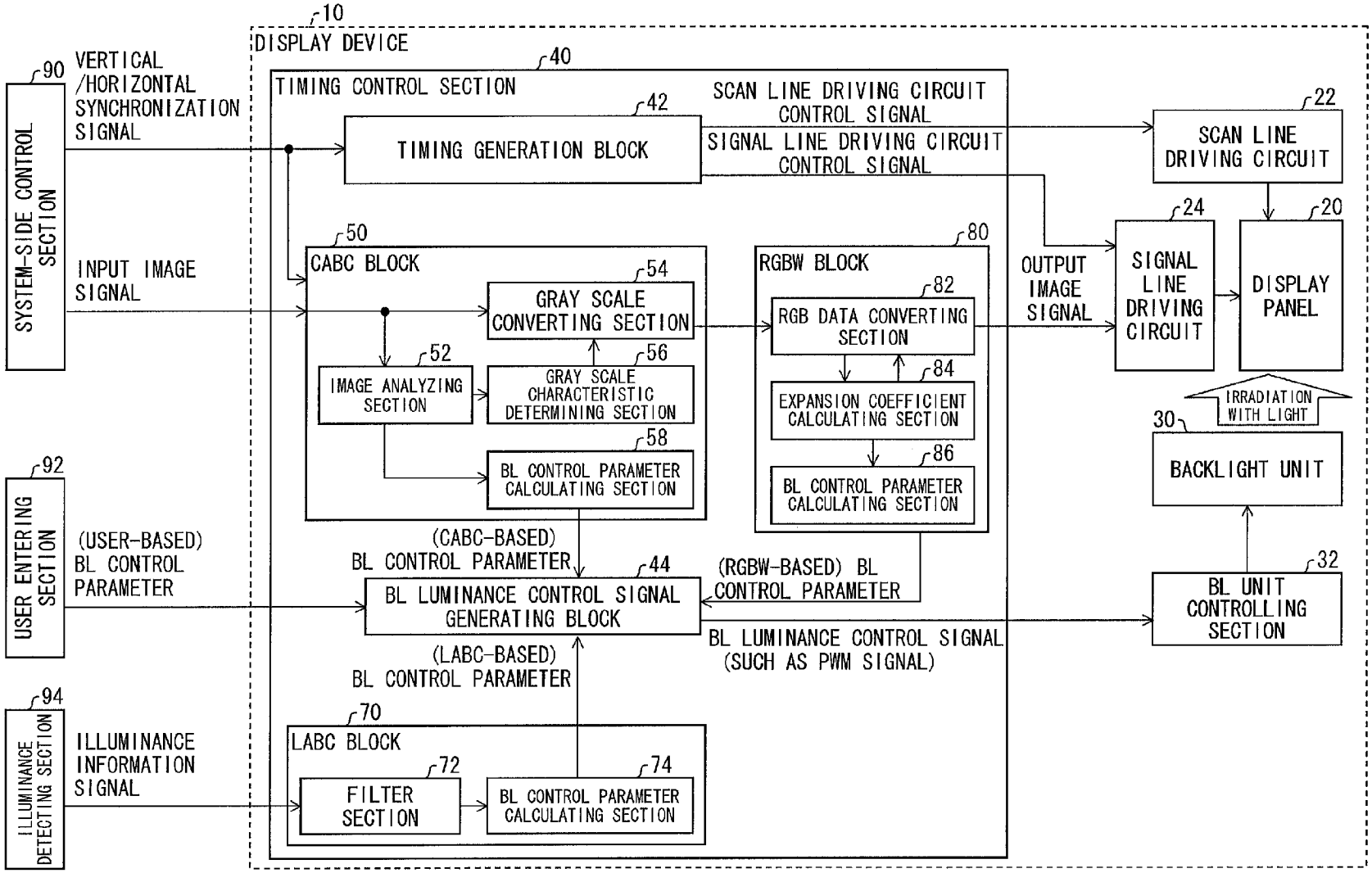
FIG. 8 is a block diagram schematically illustrating how a display device in accordance with another embodiment of the present invention is configured.

The following description will discuss a display device 10 in accordance with Embodiment 2 of the present invention with reference to FIG. 8. FIG. 8 is a block diagram schematically illustrating how the display device 10 of Embodiment 2 is configured.

Note that, for convenience, identical reference numerals are given to members having respective functions identical to those illustrated in the drawings of Embodiment 1, and descriptions of the members are omitted in Embodiment 2.

The display device 10 of Embodiment 2 is different from that of Embodiment 1 in a location where an RGBW block 80 is provided. Specifically, the RGBW block 80 of Embodiment 2 is provided in a timing control section 40, whereas the RGBW block 80 of Embodiment 1 is provided in the signal line driving circuit 24.

Since the RGBW block 80 is provided in the timing control section 40, the display device 10 of Embodiment 2 has the following advantage.

Specifically, an RGBW image processing circuit to be provided in the RGBW block 80 is in relatively large scale. It is therefore relatively easier to provide the RGBW image processing circuit (i) in the timing control section 40 (an LCD controller IC etc.) to be provided on a set-side on which the display device 10 is not provided than (ii) in a circuit (an IC etc.), like a signal line driving circuit 24 (an LCD driver IC etc.), whose size is strictly restricted because the circuit is provided in a frame region of a display panel 20 (a liquid crystal display panel etc.).

Since the RGBW block 80 is thus provided in the timing control section 40, it is possible to downsize the signal line driving circuit 24. This causes the frame region to be narrowed. It is therefore possible to improve design of the display panel 20.

Embodiment 3

Figure 9:
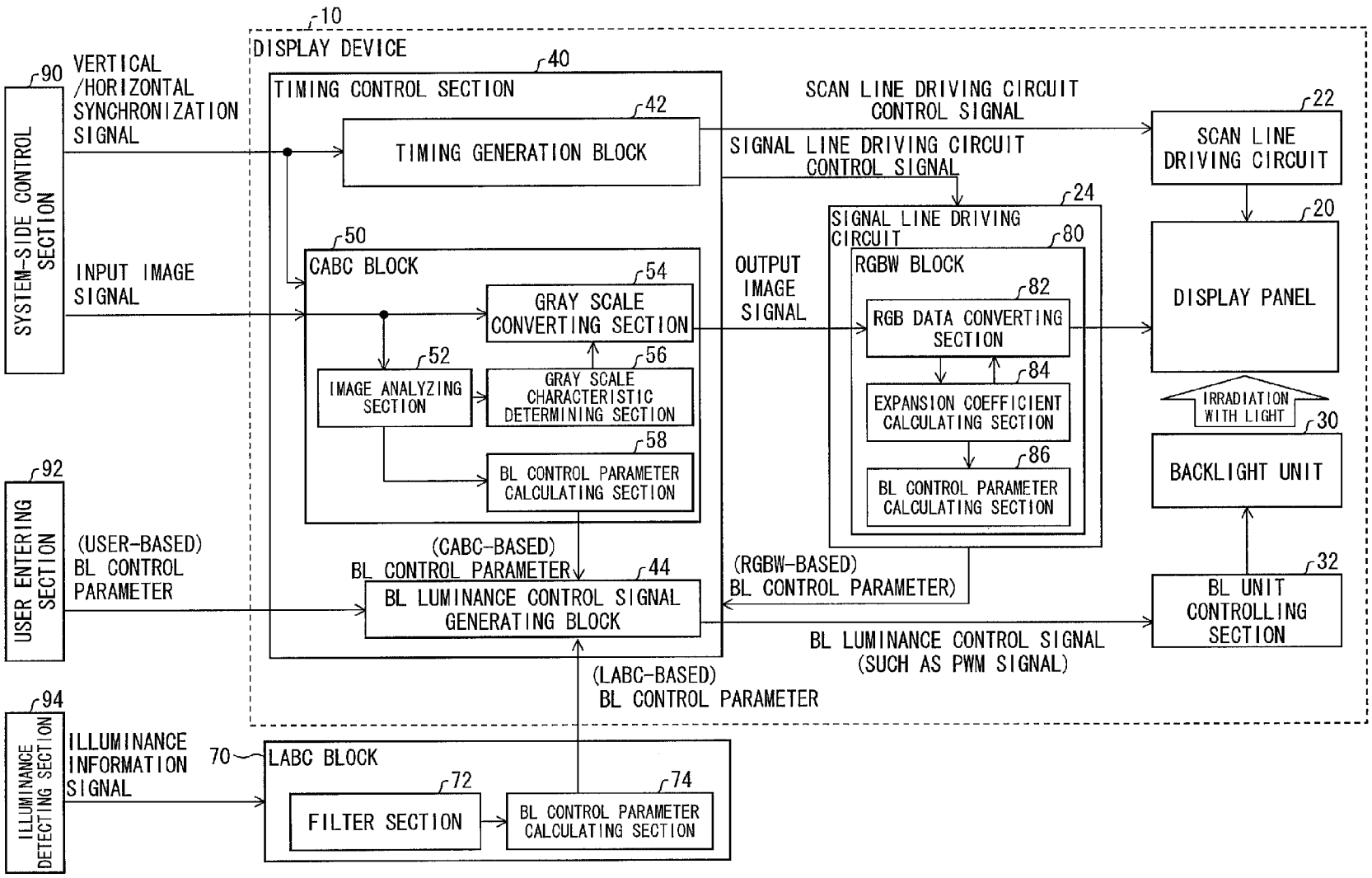
FIG. 9 is a block diagram schematically illustrating how a display device in accordance with yet another embodiment of the present invention is configured.
Figure 10:
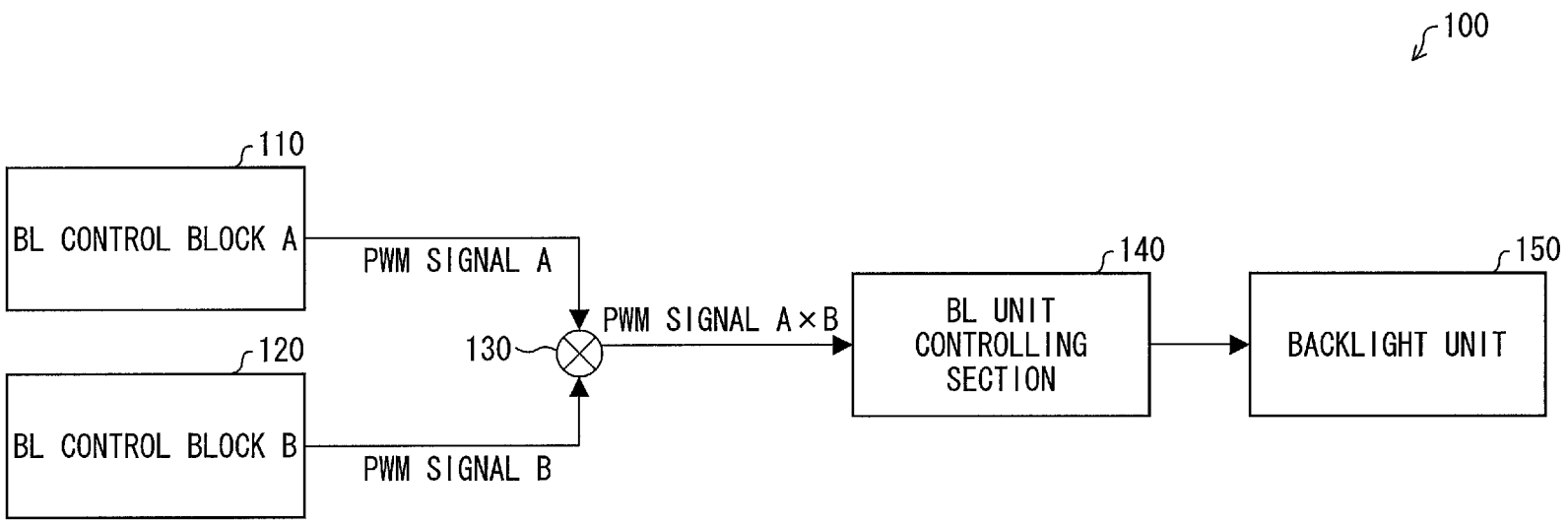
FIG. 10 is a block diagram schematically illustrating luminance control according a conventional technique.
Figure 11:
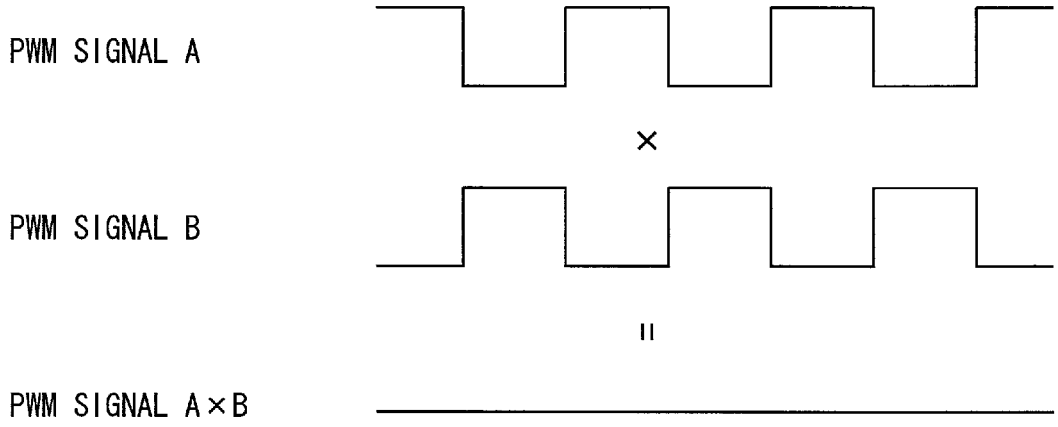
FIG. 11 is a waveform diagram schematically illustrating superimposition of PWM signals according to a conventional technique.

The following description will discuss a display device 10 of Embodiment 3 of the present invention with reference to FIG. 8. FIG. 9 is a block diagram schematically illustrating how the display device 10 of Embodiment 3 is configured.

Note that, for convenience, identical reference numerals are given to members having respective functions identical to those illustrated in the drawings of Embodiments 1 and 2, and descriptions of the members are omitted in Embodiment 3.

The display device 10 of Embodiment 3 is different from that of Embodiment 1 in a location where a LABC block 70 is provided. Specifically, the LABC block 70 of Embodiment 3 is provided independently of the display device 10, whereas the LABC block 70 of Embodiment 1 is provided in the display device 10.

Since the LABC block 70 is provided independently of the display device 10, the display device 10 of Embodiment 3 has the following advantage.

Generally, an illuminance detecting section 94 (an illuminance sensor etc.) is often provided on a substrate on a set-side on which the image display device is not provided, instead of being provided in an image display device. Because of this, an LABC block 70 is often realized by a CPU, an LSI, or the like on the set-side, not by the image display device.

By providing the LABC block 70 not in the display device 10 but independently of the display device 10, it is possible to effectively utilize a LABC function provided on the set-side. This allows (i) a structure of the LABC block 70 to be simplified, (ii) the LABC block 70 to be produced easily, and (iii) a cost to be suppressed.

(Display Panel)

The configuration of the display panel 20 of each of Embodiments 1 through 3 is not limited to a specific configuration.

For example, in a case where the display panel 20 is employed as a liquid crystal display panel, the display device 10 can be employed as a liquid crystal display device.

(Backlight Unit)

Each of Embodiments 1 through 3 has described a configuration in which the backlight unit 30 and the BL unit controlling section 32 are provided in the display device 10. The present invention is, however, not limited to such a configuration. Alternatively, for example, the backlight unit 30 and the BL unit controlling section 32 can be provided independently of the display device 10.

(Timing Control Section)

Each of Embodiments 1 through 3 has described a configuration in which the timing control section 40 is provided in the display device 10. The present invention is, however, not limited to such a configuration. For example, the timing control section 40 excluding the BL luminance control signal generating block 44 can be provided independently of the display device 10, while the BL luminance control signal generating block 44 is still provided in the display device 10.

The present invention is not limited to the description of the embodiments above, and can therefore be modified by a skilled person in the art within the scope of the claims. Namely, an embodiment derived from a proper combination of technical means disclosed in different embodiments is encompassed in the technical scope of the present invention.

The display device of the present invention is characterized in that the signal generating section is connected to a backlight unit via a backlight unit controlling section, the luminance control signal is supplied from the signal generating section to the backlight unit controlling section, and the backlight unit controlling section controls a luminance of the backlight unit in accordance with the luminance control signal.

The display device of the present invention is characterized in that the backlight unit controlling section and the backlight unit are provided in the display device.

According to the configuration, the backlight unit controlling section is provided in the display device. It can therefore be configured such that the backlight unit controlling section easily controls the luminance of the backlight in accordance with the luminance control signal generated by the signal generating section.

The display device of the present invention can be configured so that each of the plurality of parameters is a duty ratio of a PWM signal.

The display device of the present invention can be configured so that each of the plurality of parameters is a luminance level of the backlight.

The display device of the present invention is characterized in that the signal generating section generates the luminance control signal by multiplying the plurality of parameters by each other.

A method, of the present invention, of generating a luminance control signal is characterized in that the calculation process is multiplication.

According the configuration or the method, the calculation process is multiplication. It is therefore possible to make the calculation process with a simple circuit configuration. Further, by multiplying parameters by each other, it is possible to easily generate a luminance control signal on which luminance control factors are suitably reflected.

The display device of the present invention is characterized in that the luminance control signal is a PWM signal.

In a case where a control signal is a PWM signal, it is possible to easily employ a typical control circuit for controlling a backlight. This makes it easy to attain (i) simplification of a structure of the circuit and (ii) reduction in cost.

The display device of the present invention is characterized in that the plurality of parameters are supplied to the signal generating section from at least one of an image signal converting section, an external light illuminance processing section, an image information processing section, and a user entering section.

According to the configuration, the luminance of the backlight is determined on the basis of various parameters regarding the luminance of the backlight.

It is therefore possible to determine a suitable luminance of the backlight from various viewpoints such as (i) an environment where the display device is used and (ii) what is displayed in the display device.

The display device of the present invention is characterized in that the display device is a liquid crystal display device including a liquid crystal display panel as a display panel.

The method is characterized in that the calculation process is at least one of (i) calculation of an arithmetic mean value, (ii) calculation of a weighted average efficiency, (iii) extraction of a maximum value, (iv) extraction of a minimum value and (v) calculation of a median.

The method is characterized in that the calculation process is a process which is carried out based on a combination table in which luminance control signals are set in advance for respective combinations of the plurality of parameters.

INDUSTRIAL APPLICABILITY

The present invention is suitably applicable to a display device which controls a luminance of a backlight unit on the basis of a plurality of factors.

REFERENCE SIGNS LIST

10: display device
20: display panel
22: scan line driving circuit
24: signal line driving circuit
30: backlight unit
32: BL unit controlling section
40: timing control section
42: timing generation block
44: BL luminance control signal generating block
45: BL control block A
46: BL control block B
47: BL control block C
50: CABC block
52: image analyzing section
54: gray scale converting section
56: gray scale characteristic determining section
58: BL control parameter calculating section
70: LABC block
72: filter section
74: BL control parameter calculating section
80: RGBW block
82: RGB data converting section
84: expansion coefficient calculating section
86: BL control parameter calculating section
90: system-side control section
92: user entering section
94: illuminance detecting section
100: display device
110: BL control block A
120: BL control block B
130: control signal synthesizing section
140: BL unit controlling section
150: backlight unit

The invention claimed is:

1. A display device, comprising:

a signal generating controller that generates a luminance control signal to control a luminance of a backlight, wherein the signal generating controller (i) receives a plurality of parameters regarding the luminance of the backlight, (ii) carries out a calculation process with respect to the plurality of parameters, and (iii) generates the luminance control signal on the basis of a result of the calculation process, the plurality of parameters include at least three parameters including at least (i) a parameter that is calculated when an input image is converted to an output image via gray scale conversion, and (ii) a parameter that is calculated when RGB data of the output image is converted into RGBW data, and the calculation process includes a combination of at least two different calculations.

2. The display device as set forth in claim 1, wherein:

the signal generating controller is connected to the backlight via a backlight controller, the luminance control signal is supplied from the signal generating controller to the backlight controller, and the backlight controller is configured to control the luminance of the backlight in accordance with the luminance control signal.

3. A display device as set forth in claim 2, wherein:

the backlight controller and the backlight are provided in said display device.

4. The display device as set forth in claim 1, wherein:

the signal generating controller generates the luminance control signal by multiplying the plurality of parameters by each other.

5. The display device as set forth in claim 1, wherein:

the luminance control signal is a PWM signal.

6. The display device as set forth in claim 1, wherein:

the plurality of parameters are supplied to the signal generating controller from at least one of an image signal converting circuit, an external light illuminance processor, an image information processor, and a user entering input.

7. A display device as set forth in claim 1, wherein the display device is a liquid crystal display device including a liquid crystal display panel as a display panel.

8. A method of generating a luminance control signal for controlling a luminance of a backlight, the method comprising the steps of:

(i) carrying out a calculation process in advance with respect to a plurality of parameters regarding the luminance; and (ii) generating the luminance control signal on the basis of a result of the calculation process; wherein the plurality of parameters include at least three parameters including at least (i) a parameter that is calculated when an input image is converted to an output image via gray scale conversion, and (ii) a parameter that is calculated when RGB data of the output image is converted into RGBW data, and the calculation process includes a combination of at least two different calculations.

9. The method as set forth in claim 8, wherein:

the calculation process is multiplication.

10. The method as set forth in claim 8, wherein:

the calculation process is at least one of (i) calculation of an arithmetic mean value, (ii) calculation of a weighted average efficiency, (iii) extraction of a maximum value, (iv) extraction of a minimum value, and (v) calculation of a median.

11. The method as set forth in claim 8, wherein:

the calculation process is a process which is carried out based on a combination table in which luminance control signals are set in advance for respective combinations of the plurality of parameters.

* * * * *